US006783403B2

(12) United States Patent
Lafragette et al.

(10) Patent No.: US 6,783,403 B2
(45) Date of Patent: Aug. 31, 2004

(54) CONNECTION DEVICE FOR AN ELECTRONIC BOX

(75) Inventors: Pascal Lafragette, Macon (FR); Johann Cisey, Saint Symphorien d'Ancelles (FR); Luc Doutaz, Bron (FR)

(73) Assignees: ABB Entrelec, Villeurbanne (FR); Siemens AG, Nürnberg (DE)

( * ) Notice: Subject to any disclaimer, the term of this patent is extended or adjusted under 35 U.S.C. 154(b) by 0 days.

(21) Appl. No.: 10/341,491

(22) Filed: Jan. 14, 2003

(65) Prior Publication Data

US 2003/0139080 A1 Jul. 24, 2003

(30) Foreign Application Priority Data

Jan. 15, 2002 (FR) ..... 02 00444

(51) Int. Cl.[7] ..... H01R 9/22
(52) U.S. Cl. ..... 439/717
(58) Field of Search ..... 439/715, 716, 439/717

(56) References Cited

U.S. PATENT DOCUMENTS

| | | | | | |
|---|---|---|---|---|---|
| 4,729,744 | A | * | 3/1988 | Bet et al. | 439/717 |
| 5,222,670 | A | | 6/1993 | Huang | 439/222 |
| 5,841,616 | A | | 11/1998 | Crosier | 361/102 |
| 6,027,379 | A | * | 2/2000 | Hohorst | 439/715 |
| 6,283,801 | B1 | | 9/2001 | Guinda et al. | 439/835 |

FOREIGN PATENT DOCUMENTS

DE 196 50 988 A1 6/1998

* cited by examiner

*Primary Examiner*—Tho D. Ta
*Assistant Examiner*—Ann McCamey
(74) *Attorney, Agent, or Firm*—Oliff & Berridge, PLC

(57) ABSTRACT

Connection device for an electronic box includes a connection module intended to be mated with the longitudinal assembling face of a box and making an electrical connection with, on the one hand, pins projecting from this longitudinal assembling face and, on the other hand, with conducting cables. The pins are longitudinal and the module is fastened to the box by a system of discontinuous slideways allowing them to be fastened by longitudinal sliding and reversible locking via a resilient tab fitted into a recess in the box.

12 Claims, 4 Drawing Sheets

CONNECTION DEVICE FOR AN ELECTRONIC BOX

1. FIELD OF INVENTION

The subject of the present invention is a connection device for an electronic box.

2. DESCRIPTION OF RELATED ART

Electronic boxes used in the industrial field are generally mounted in cabinets and are juxtaposed on one and the same rack, it being possible for several racks to be superimposed. These boxes possess a parallelepipedal general shape and each has one or more connection pins for connecting them to conducting cables that are connected to various types of equipment, such as timepiece systems, relays or signal processing equipment.

The connection pins connected to the electronic card contained in each electronic box are flat pins oriented parallel to the longitudinal assembling face of the box.

Since in general a box is accessible only via a longitudinal face, connection to the conducting cables is accomplished by means of connection modules each fixed to the longitudinal assembling face of a box. A connection module contains connection pieces, for connection to the horizontal flat pins, and a device for fastening the conducting cables which are brought into contact with the aforementioned connection pieces. The conducting cables are generally introduced into the connection module either via the top face thereof or via a longitudinal face thereof.

A connection module is fastened to the longitudinal assembling face of a box by an irreversible snap-fastening device, the module being brought up to the box by a movement transverse to this face. Should it be necessary to carry out work in a box, for example in order to change an electronic card, the connections between the conducting cables and the connection module have to be disconnected. After carrying out work in the box, the conducting cables have to be reconnected. From the foregoing, it follows that this operation is a lengthy and expensive operation, with the risk of wiring errors.

SUMMARY OF THE INVENTION

The object of the invention is to provide a connection device for an electronic box, comprising a connection module that can be wired before it is fitted onto the box and which can be disconnected from the box simply and quickly, without any deterioration and without requiring to disconnect the conducting cables. The object of the invention is therefore to provide a device in which a connection module can be disconnected and reconnected instantly, without disconnecting the conducting cables.

For this purpose, such a device, of the type comprising a connection module intended to be mated with the longitudinal assembling face of a box and making an electrical connection with, on the one hand, pins projecting from this longitudinal assembling face and, on the other hand, with conducting cables, is one in which:

- the connection pins projecting from the longitudinal assembling face of the box are flat pins oriented so as to be parallel to the lateral faces of the box that are adjacent to neighboring boxes;
- the longitudinal assembling face of the box is bounded laterally by two parallel recesses partly blocked near the longitudinal assembling face by at least one lug;

- the assembling face of the module for joining onto the box includes slots oriented parallel to the lateral faces, each slot designed to receive a flat pin on the box, with the possibility of being moved along the direction of the slots of the module relative to the box as far as a locking position in which each flat pin is engaged in a tuning-fork-shaped connection piece placed in the module;
- the assembling face of the module for joining onto the box is bounded laterally, over part of its height, by two parallel side walls each protruding forward and including an inward return having at least one recess, allowing, in a defined longitudinal position, passage for the lugs on the box and then the retention of said lugs in another longitudinal position corresponding to the locking position;
- the assembling faces of the box and module respectively include, near their edge facing away from that for connection of the pins, a recess and a retractable resilient tab respectively, said tab being designed to fit into the recess in the locked position of the module.

From a practical standpoint, a connection module may be preequipped with conducting cables. To connect it to the electronic box, the module has to be moved transversely up to the box, the module being offset longitudinally with respect to the box, so that the lugs and returns on the box and the module respectively can interpenetrate. During this movement, the vertical pins on the box penetrate the slots in the module, the slots being placed in such a way that there is no electrical contact during this stage of the movement. When the opposing faces of the box and the module are in contact with each other, the operator moves the module longitudinally, so as to make electrical contact and then to effect the locking, which is obtained by engagement of the deformable tab belonging to the module in the recess provided in the longitudinal assembling face of the box. Retention of the module in the box is achieved by co-operation between the lugs on the box and the returns on the module, whereas the locking is achieved by co-operation between the tab on the module and the corresponding recess in the box.

By acting on this resilient tab, in the direction of extraction from the recess in which it is housed, it is possible, by a longitudinal movement followed by a transverse movement, to disconnect the module from the box. This disconnection is performed instantly and allows access to the inside of the box. It is worth pointing out that this disconnection is effected without disconnecting the conducting cables from the module. Work in a box can therefore be carried out simply and very quickly since any subsequent wiring operations are avoided, it being possible for the module, which has been disconnected together with the cables that are connected to it from the box, to be immediately reconnected to the box after the work has been carried out in the box or after the latter has been replaced.

To make the work by the operator easier, the respective lengths of the lugs on the box and of the recesses of the returns on the module are determined in order to form polarizers and to allow the module to be mounted on the box in only one way.

To make it easier to disconnect the connection module, the latter includes, in its face adjacent to its assembling face for joining onto the box, a recess giving access to the resilient locking tab in order to actuate the latter using a tool.

According to one advantageous embodiment of this device, a connection module comprises a body inside which are mounted a number of drawers, each containing a piece for connection to a flat pin on the box and at least one piece for fastening a conducting cable.

Each drawer is in the form of a piece having a parallelepipedal general shape, made of synthetic material, one of the lateral faces of which is open and the inside of which contains partitions projecting from the opposed lateral face, serving to press against, and to hold in place, the tuning-fork-shaped connection piece and the piece or pieces for fastening the conducting cables.

Several drawers are therefore juxtaposed inside the body of a module, the open face of each drawer being adjacent to the closed face of the neighboring drawer.

To fasten each drawer in the body of the module, the drawer includes, on its two faces adjacent to the open face, two snap-fastening spurs intended to penetrate two recesses provided in the facing walls of the module.

According to one embodiment of this device, the piece for electrical connection to a conducting cable is formed by a looped metal hairpin fitted over a stud on the drawer and projecting from that face of the latter on the opposite side from the open face.

Advantageously, and if it should be necessary to make an electrical connection between a piece and two conducting cables, the hairpin, for the retention of at least one cable, is a double hairpin obtained on the same metal strip slit along its length except in a joining region, the two parts, lying on either side of the slit, each having an opening for passage of a cable and each hairpin part being able to be actuated independently of the other part in order to fasten a cable. This solution makes it possible to use only a single element forming two hairpins, instead of two hairpins in the conventional case, this being advantageous from the economic standpoint and simplifying the fitting conditions.

BRIEF DESCRIPTION OF THE DRAWINGS

In any case, the invention will be more clearly understood with the aid of the description which follows, with reference to the appended schematic drawing showing, as nonlimiting examples, several embodiments of this device.

DETAILED DESCRIPTION OF EXEMPLARY EMBODIMENTS

Figure 1:
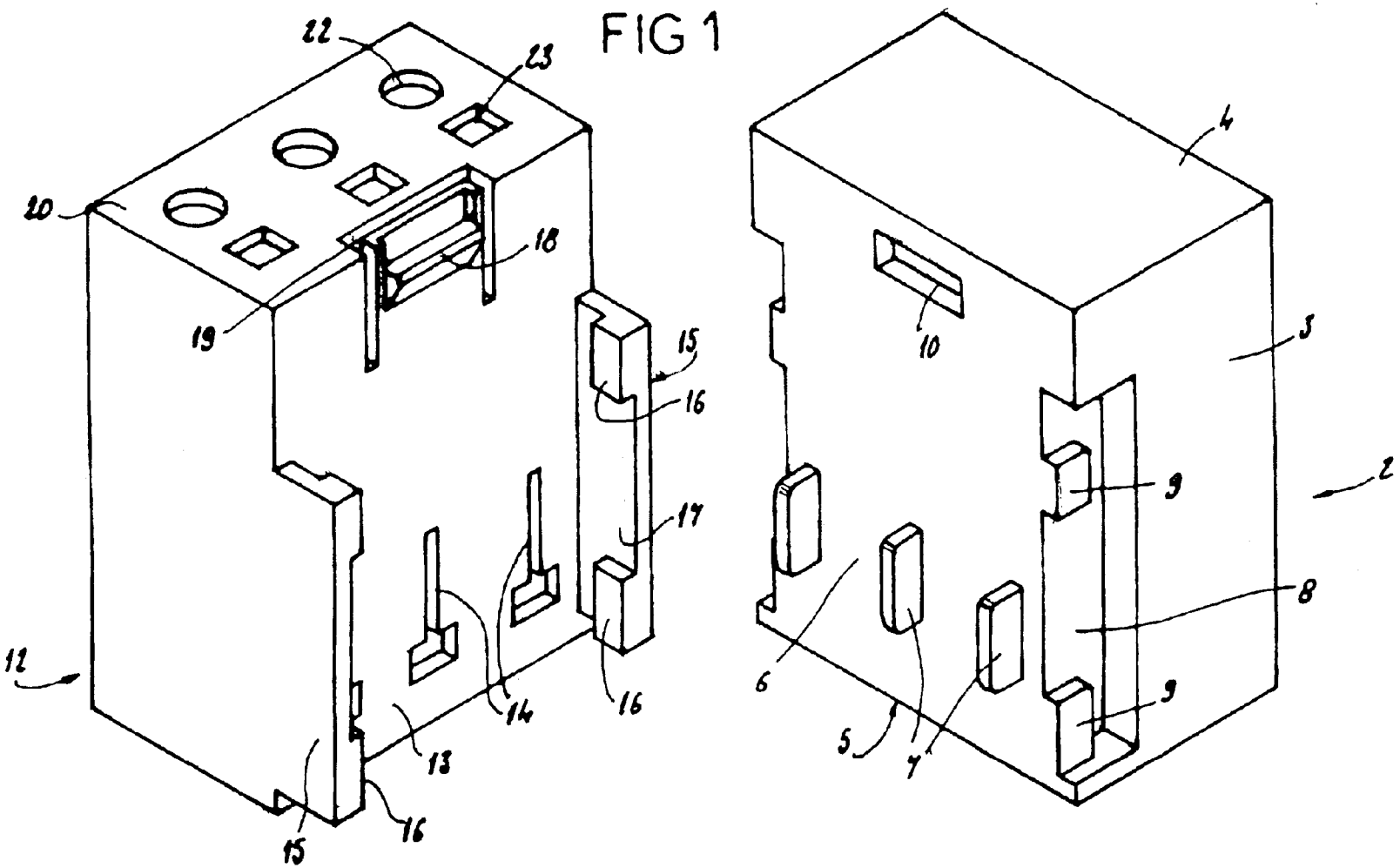
FIG. 1 is a perspective view of an electronic box and a connection module.

FIG. 1 shows a box 2 for containing at least one electronic card, having a parallelepipedal general shape, bounded in particular by two side walls 3, a front face 4, a bottom 5 and a longitudinal assembling face 6. Protruding from the longitudinal assembling face, close to the lower edge of the box, are three flat conducting pins 7 connected to the printed circuit.

The longitudinal assembling face of the box is bounded laterally by two parallel recesses 8, partially blocked near the longitudinal assembling face by two lugs 9.

Provided in the longitudinal assembling face 6, near the upper face 4 of the box 2, is a recess 10.

FIG. 1 also shows a connection module denoted by the general reference 12. The assembling face 13 of the module for joining onto the box includes longitudinally oriented slots 14, each designed to receive a flat pin 7 projecting from the box, with the possibility of each flat pin 7 moving inside the corresponding slot 14 when the module is moved longitudinally with respect to the box. The assembling face 13 of the module 12 is bounded laterally and over part of its length by two parallel side walls 15, each protruding forward and having an inward return 16, each return 16 having a central recess 17 allowing, in a defined longitudinal position of the module with respect to the box 2, passage of the lugs 9 on the box and then their retention in the locking position, the lugs 9 then being behind the returns 16.

The assembling face 13 of the module 12 includes, near its upper edge, a resilient tab 18 designed to fit into the recess 10 in the box 2, in the locking position. This tab 18 is accessible via a recess 19 that opens into the upper face of the module 12. Provided in the upper face 20 of the module 12 are three openings 22 for engagement of electrical conductors, and three openings 23 for actuating the retention means for these conductors. The reference frame used above takes into account the position of the module in the drawing, but does not necessarily correspond to the position in use.

In practice, the cables may firstly be fastened in the module 12. Once this fastening operation has been carried out, the module is brought up to the box transversely, until it butts against the latter, with interpenetration of the lugs 9 and the return 16 on the side walls of the module. During this movement, the flat pins 7 penetrate the slots 14. The module 12 is then moved longitudinally downward, during which movement the connection is made between the flat pins 7 and the connection pieces housed in the module 12, and during which movement the returns 16 on the module become locked behind the lugs 9 on the box 2. At the end of the longitudinal movement, the resilient tab 18 penetrates the recess 10. This connection is reversible as all that is required is to rock the resilient tab 18, for example using a screwdriver, in order to disengage it from the recess 10, before moving the module 12 longitudinally in order to allow the returns 16 to escape from the lugs 9 on the box and to pull the module transversely in order to allow access to the box. It should be noted that this operation is carried out without disconnecting the electrical cables.

Figure 2:
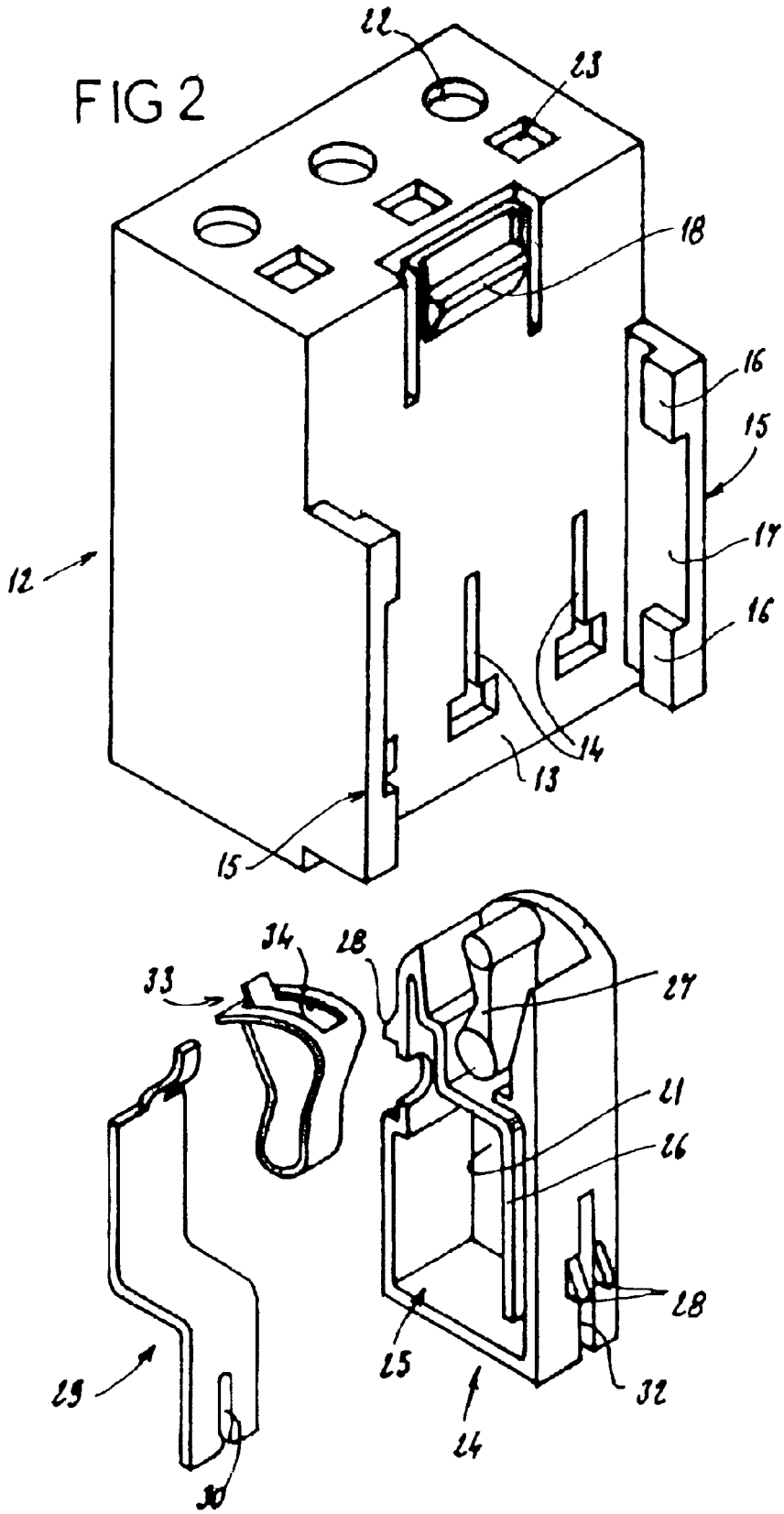
FIG. 2 is an exploded perspective view of a connection module and the component parts of an insert associated with this module.
Figure 3:
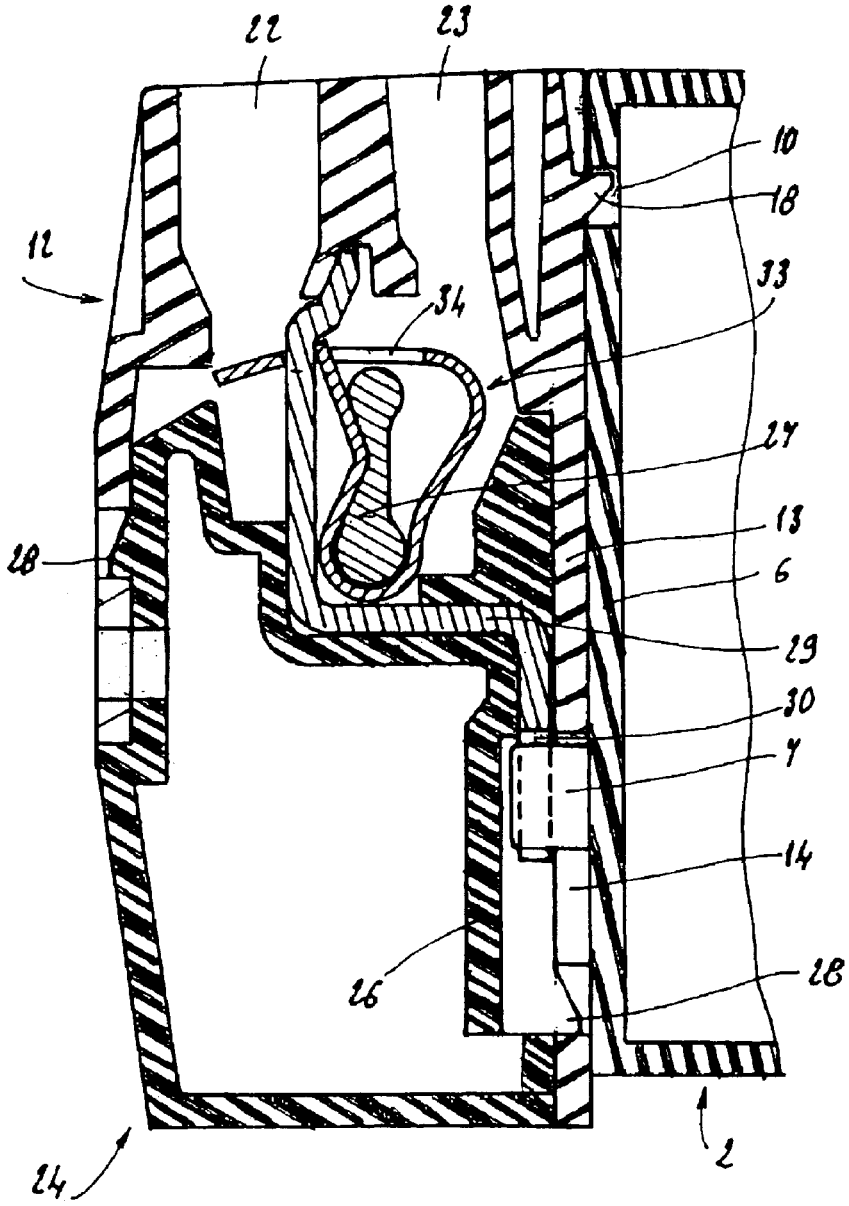
FIG. 3 is a longitudinal sectional view on an enlarged scale showing an insert mounted inside a connection module.

FIG. 2 shows an embodiment detail of the module 12. The module 12 comprises a body in which several drawers 24 are housed. There are as many drawers 24 as there are connections to the flat pin 7 to be made. Each drawer 24 is formed by a piece made of synthetic material, of parallelepipedal general shape, one of the faces, 25, of which is open. Provided inside the drawer 24 are partitions 26 and a stud 27 protruding from the face 21 on the opposite side to the open face 25. Each drawer 24 has, on two opposed faces, snap-fastening spurs 28 designed to fit, as shown in FIG. 3, into openings that the constituent casing of the module has. In the embodiment shown in the drawing, each drawer 24 contains a conducting connection piece 29 having the general shape of an S, fitted against bearing partitions 26 and the lower end of said connection piece has a tuning-fork-shaped slot 30, this slot 30 being located opposite a slot 32 in the drawer 24, this slot 32 itself being located opposite a slot 14 in the module. A flat pin 7 will therefore pass through the slot 14 in the module and the slot 32 in the drawer 24 in order to fit into the slot 30 in the tuning fork of the connection piece 29. During the transverse movement of the module 12, there is no electrical contact between a pin 7 and the piece 29.

During the longitudinal movement of the module, the pin 7 engages in the slot 30, making electrical contact with the piece 29.

The drawer 24 also contains a hairpin-shaped piece 33 closed up on itself, this hairpin being a resilient hairpin of a type known per se, having an opening 34 for passage of a conducting cable. In practice, before engagement of a conducting cable, a tool such as a screwdriver is fitted into the opening 23 of the module in order to deform the hairpin 33 and clear the opening 34 therein, by bringing it opposite the opening 22 via which the conducting cable is engaged. When the end of the conducting cable is in contact with the connection piece 29, the action exerted by the tool on the hairpin 33 is released and the latter relaxes, ensuring that the conducting cable is fastened.

Figure 4:
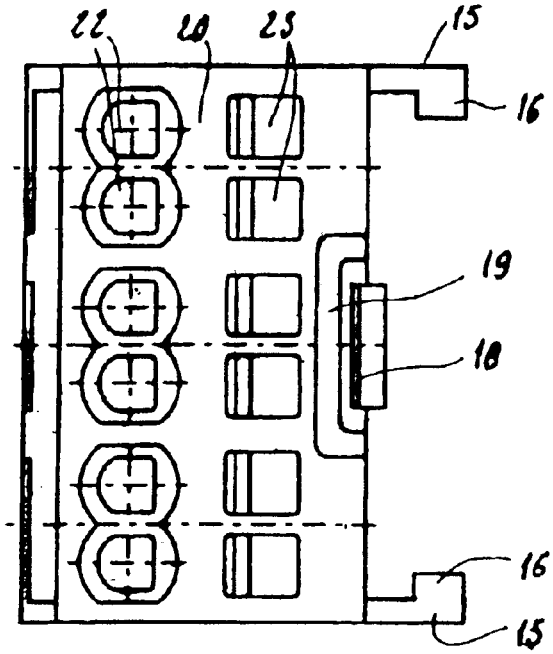
FIG. 4 is a top view of an alternative embodiment of the module of FIGS. 1 to 3.
Figure 5:
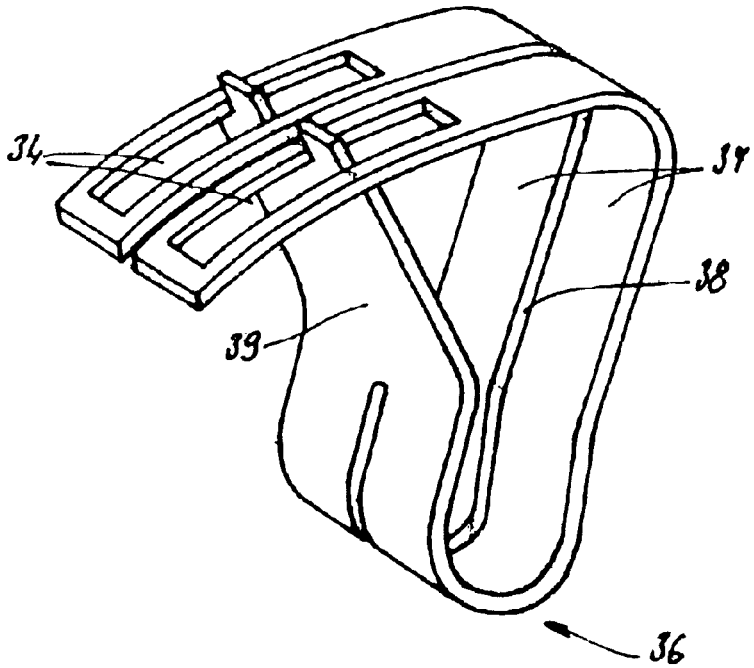
FIG. 5 is a perspective view on an enlarged scale of a double hairpin designed to retain two conducting cables in the module.

FIG. 4 shows a top view of an alternative embodiment of a module, in which the same elements are denoted by the same references as previously. In this case, each flat pin 7 is to be connected to two electrical conductors. For this purpose, each drawer is equipped, not with two hairpins, but with a double hairpin 36 made from the same metal strip, split into two parts 37 lying on either side of a slit 38, the two parts 37 remaining joined together by one 39 of the ends of the hairpin. An opening 34 is provided in each of the parts 37 of the hairpin, each opening 34 being designed to allow passage of a conducting element. This double hairpin has the advantage of being formed by only a single piece instead of two pieces and of requiring only a single piece to be fitted, instead of two pieces, this being economically advantageous.

As is apparent from the foregoing, the invention greatly improves the existing technique by providing a connection device for an electronic box, which has a simple structure, allows easy and non-destructive disconnection and is very practical to implement by users.

As goes without saying, the invention is not limited to merely the embodiments of the device described above by way of example, rather it encompasses any variant thereof. Thus, in particular the means for connecting the conducting cables could consist of clips and screw means, without thereby departing from the scope of the invention.

What is claimed is:

1. A connection device, comprising:

an electronic box having a longitudinal assembling face with connection pins projecting therefrom; and a connection module usable to be mated with the longitudinal assembling face for making an electrical connection between the connection pins and connecting cables, wherein:

the connection pins are fist pins parallel to lateral faces of the box;

the longitudinal assembling lace is bounded laterally by two parallel recesses, each of the two parallel recesses partly blocked by at least one lug at a location near the longitudinal assembling face;

the connection module comprises an assembling face for mating onto the longitudinal assembly face of the box, the assembling face of the connection module including slots oriented parallel to lateral faces of the connection module, each slot designed to receive one of the connection pins, the connection pins moveable along the slots, each slot having a locking position at which a respective connection pin is engaged in one of at least one turning-fork-shaped connection piece in the connection module;

the assembling face of the connection module is bounded laterally by two parallel side walls each protruding forward and including an inward return, the return having at least one recess, the at least one recess allowing passage for the at least one lug, the return allowing retention of the at least one lug at a position corresponding to the locking position;

one of the assembling face of the connection module and the longitudinal assembling face of the box includes a face recess, the other of the longitudinal assembling face of the box and the assembling face of the connection module includes a retractable resilient tab, the tab designed to fit into the recess at a position corresponding to the locking position.

2. The connection device as claimed in claim 1, wherein the connection module comprises a number of drawers, each drawer containing one of the at least one turning-fork-shaped connection piece for connection to one of the connection pins on the box and at least one piece for fastening a conducting cable.

3. The connection device as claimed in claim 2, wherein each drawer has a substantially parallelepipedal shape, and is made of a synthetic material, each drawer having an open lateral face and enclosing partitions projecting from a lateral face that is opposite to the open lateral face, serving to press against, and to hold in place, the tuning-fork-shaped connection piece and the at least one piece for fastening the conducting cable.

4. The connection device as claimed in claim 3, wherein the at least one piece for fastening the conducting cable is formed by a looped metal hairpin fitted over a stud on the drawer and projecting from the face that is opposite to the open face.

5. The connection device as claimed in claim 4, wherein the hairpin for fastening the conducting cable is a double hairpin obtained on a same metal strip slit into two parts along a length of the metal strip except in a joining region, the two parts each having an opening for passage of a conducting cable and each being able to be independently actuated.

6. The connection device as claimed in claim 1, wherein the at least one lug and the recess of the return are dimensioned to form polarizers and to allow the connection module to be mounted on the box in only one way.

7. The connection device as claimed in claim 6, wherein the connection module includes, in a face adjacent to the assembling face for joining onto the box, a recess for actuating the resilient tab.

8. The connection device as claimed in claim 6, wherein the connection module comprises a number of drawers, each drawer containing one of the at least one turning-fork-shaped connection piece for connection to one of the connection pins on the box and at least one piece for fastening a conducting cable.

9. The connection device as claimed in claim 1, wherein the connection module includes, in a face adjacent to the assembling face for joining onto the box, a recess for actuating the resilient tab.

10. The connection device as claimed in claim 9, wherein the connection module comprises a number of drawers, each drawer containing one of the at least one turning-fork-shaped connection piece for connection to one of the connection pins on the box and at least one piece for fastening a conducting cable.

11. The connection device as claimed in claim 3, wherein each drawer includes, on two faces adjacent to the open face, two snap-fastening spurs usable to penetrate two recesses in a wall of the connection module that faces the spurs.

12. The connection device as claimed in claim 11, wherein the at least one piece for fastening the conducting cable is formed by a looped metal hairpin fitted over a stud on the drawer and projecting from the face that is opposite to the open face.

* * * * *